US005593709A

United States Patent [19]

Thomson et al.

[11] Patent Number: 5,593,709

[45] Date of Patent: Jan. 14, 1997

[54] MOLD FOR FORMING PANELS FOR PREFABRICATED CONSTRUCTION

[75] Inventors: Donald W. Thomson, San Jose, Costa Rica; Frank B. Nichols, Redding, Calif.

[73] Assignee: Consorcio Can-Tico, S.A., Alajuela, Costa Rica

[21] Appl. No.: 511,054

[22] Filed: Aug. 3, 1995

[51] Int. Cl.[6] ..... B28B 7/16; B28B 7/22

[52] U.S. Cl. ..... 425/454; 425/436 R; 249/35; 249/39; 249/160; 249/187.1; 249/189

[58] Field of Search ..... 249/35, 36, 189, 249/160, 170, 33, 39, 187.1; 425/436 R, 436 RM, 453, 454, 62, 403.1

[56] References Cited

U.S. PATENT DOCUMENTS 3,844,522 10/1974 Cochran ..... 249/35
3,890,075 7/1975 Bourdo ..... 425/454
4,149,697 4/1979 Linetsky ..... 425/454
4,181,485 1/1980 Schramm ..... 425/454
5,169,544 12/1992 Stanfill et al. ..... 249/36
5,216,860 6/1993 Thomson et al. .

*Primary Examiner*—Khanh P. Nguyen
*Attorney, Agent, or Firm*— Townsend and Townsend and Crew LLP

[57] ABSTRACT

A moldplate, defining first and second planar surfaces, is constructed to have a lift foot that supports a prefabricated panel for lifting and transport. The moldplate includes support tabs that attach to a lifting truss in a manner that positions one surface of the moldplate so that a vector normal to the mold surface has a horizontal component and an upward, vertical component to support the slabs during lifting and transport to a drying station. The moldplate can be positioned in spaced, confronting, generally parallel vertical relation to a fixed, planar surface with a peripheral sidewall positioned between the two surfaces, defining a void for receiving a pourable material to vertically form the prefabricated panel.

18 Claims, 3 Drawing Sheets

MOLD FOR FORMING PANELS FOR PREFABRICATED CONSTRUCTION

BACKGROUND OF THE INVENTION

The present invention relates to techniques for forming, from a pourable material such as liquid concrete, pre-cast, re-enforced panels used in prefabricated building construction, and more particularly to mold apparatus that can support pre-cured panels for lifting and transporting to a drying station where a number of the panels can be vertically stacked for controlled curing.

The advantages of concrete construction for buildings has long been known. Those advantages include high fire ratings, seismic resistance, and pertinent here, use for prefabricated building construction in which a structure's constituent wall section panels may be pre-cast at one location and transported to the building site for assembly when needed.

However, prefabricated construction is not without its disadvantages. Conventional techniques use horizontally placed forms for forming panels. Reinforcement bars are placed in the form, and liquid concrete, or other pourable material, introduced into the form, and left to cure—which can take upwards of 18 hours or more, depending upon the ambient environment in which the pre-casting takes place. In addition to precluding use of the form until the panel has cured sufficiently to have the structural integrity to be moved, the space itself is rendered unavailable until the panel cures. Further, the drying panels are often left exposed to direct sunlight to cause them to hydrate at an uneven rate. For this reason drying panels are periodically watered to effect a more even drying, which may prevent uneven drying, but lengthens the time for the panel to fully cure.

To attempt to alleviate these and other problems, a number of proposals have been put forward to enhance the curing process, including the use of chemical additives such as cure accelerators, varying the mix ratios of the pourable material used, or steam curing the panels, all of which add to the cost of manufacture both in terms of monetary expense and labor. As a result, pre-cast panels are not used as much as would be in building construction if panel manufacture cost and/or cycle times were not what they are.

Thus, as can be seen, improved pre-cast manufacture techniques that can decrease the manufacture cycle time are needed in order to take advantage of the advantages offered by prefabricated construction.

SUMMARY OF THE INVENTION

The present invention provides a form for prefabricated panel construction that is easy to use and inexpensive to construct, and permits vertical and horizontal formation of prefabricated panels.

Broadly, the present invention is a moldplate that defines at least one planar surface on which a pre-cast panel may be formed. A top periphery of the moldplate carries lifting tabs that are configured to be removably connected to lift truss for lifting and carrying the moldplate in a manner that orients the planar surface of the moldplate in an upward-facing, tilted fashion. The bottom periphery of the moldplate provides a lift foot for supporting a pre-cured or "green" panel carried on the tilted planar surface.

A periphery sidewall form is used with the moldplate to define the outer periphery of the pre-cast panel.

The moldplate may be used horizontally, or vertically for pre-cast panel manufacture. When used horizontally, the periphery sidewall form is placed on, or affixed to, the horizontally positioned planar surface of the moldplate, and a pourable material, such as liquid concrete, introduced into the space or void formed by the planar surface and periphery sidewall. The pour is allowed to sit for a short period to allow the panel solidify. The moldplate is then attached to the lift truss and lifted to its tilted attitude. In this attitude the lift foot and tilted planar surface support the uncured panel so that it can be transported to a drying area, where it may be stacked with other uncured panels for curing.

If the moldplate is used to vertically manufacture pre-cast panels, moldplate is positioned in spaced, generally parallel relation to a fixed, planar surface with the sidewall periphery form located in the interstitial area between two planar surfaces, defining a void for receiving the pourable material for pre-cast panel manufacture. Portions of the sidewall are open to permit ingress of the pourable material when forming the panel in vertical orientation. After pouring, and solidifying, the panel may be lifted in the manner described above and transported to a curing area.

In an alternate embodiment of the invention, the moldplate is constructed for vertical manufacture of a number of pre-cast panels at the same time. In this embodiment a number of moldplates are constructed as described above, with the addition of a second planar surface on the side of the moldplate opposite the (first) planar surface. A number of such two-surfaced moldplates are arranged in vertical, spaced, parallel relation with one another. Periphery sidewall molds are placed in the interstitial spaces between confronting surfaces of adjacent moldplates. A pourable material is then introduced into all voids defined by the spaces between confronting surfaces and sidewall forms. When the panels have sufficiently solidified, the panels can be lifted, in tilted, supportive fashion, and transported to a curing area.

A number of advantages are achieved by the present invention. The ability to lift and transport uncured panels from a pouring area to a curing area frees up the pouring area for manufacture of more pre-cast panels while prior formed pre-cast panels continue to cure. Additionally, the forms themselves can be used again while curing of prior panels takes place. With as little as 3 to 4 hours to solidify the panel material, the cycle frequency can be increased 3 to 5 times that achieved by conventional pour methods.

At the curing area, the uncured panels can be stacked in a manner that minimizes the exposed surfaces of the panels, allowing them to dry at a more controlled rate, lessening their exposure to direct sunlight, and their need for watering during curing.

These, and other advantages and aspects of the invention, will become apparent to those skilled in this art upon a reading of the following detailed description, which should be taken in conjunction with the accompanying drawings.

DETAILED DESCRIPTION OF THE INVENTION

Figure 1:
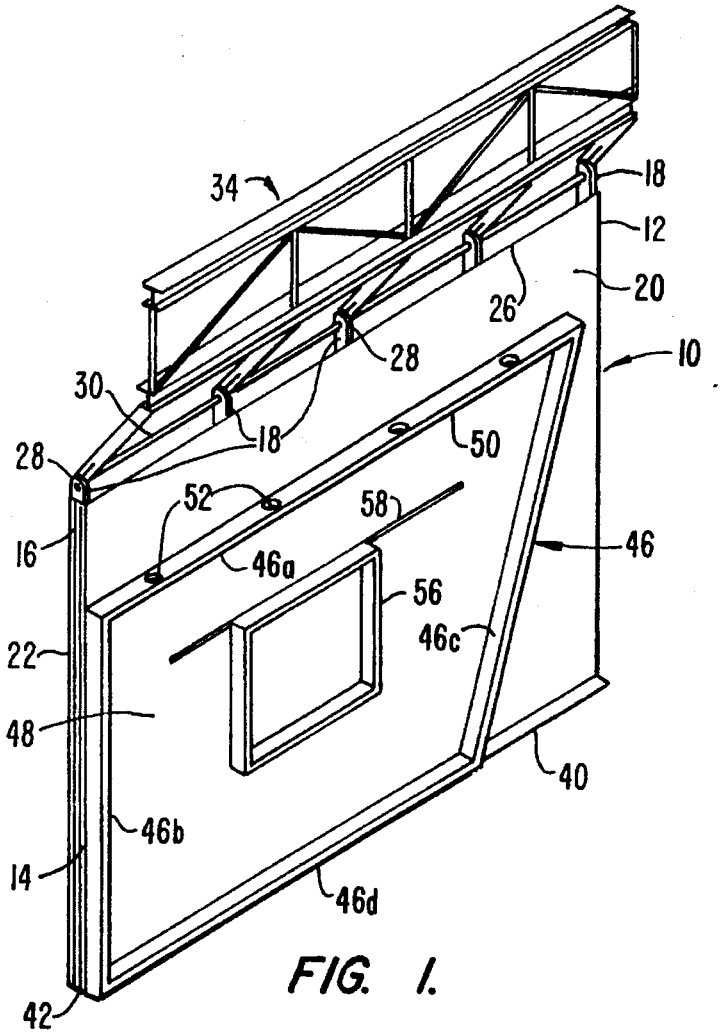
FIG. 1 is a perspective view of the moldplate of the present invention together with the lift truss connected thereto.

Turning now to the figures, for the moment specifically FIG. 1, illustrated and designated generally with the reference numeral 10 is a pre-cast panel construction system according to the present invention. The system 10 is shown including a double-sided moldplate 12 formed from a pair of spaced plates 14, 16 joined to one another such as, by welding, to linear support members 18. The outer surfaces of the plates 14, 16 define outer front and back planar mold surfaces 20, 22. (Surface 22 is hidden from view in FIG. 1, but is seen in the side elevation of FIG. 3.)

The support members 18 are dimensioned to extend beyond a top periphery 26 of the moldplate 12 to define apertured support tabs 28. The apertures formed in each of the support tabs 28 are coaxial with one another so that they may receive an elongate crossbar 30 which pivotally connects the moldplate 12 to a lift truss 34. As will be seen, the connection between the lift truss 34 and the moldplate 12 is such that the moldplate can be lifted in a manner that positions the front surface 20 tilted slightly upward (approximately 15 degrees) to permit supportive lifting and transport of a green, pre-cured panel.

Additional support of a green panel when lifted for transport is provided by a lift foot 40 that is formed at the bottom periphery 42 of the moldplate 12, and extending generally perpendicularly away from the front surface 20 as shown.

Situated on the front surface 20 of the moldplate 12 is a sidewall form that defines, with the front surface 20, a void 48 that will receive a pourable material for forming a pre-cast panel; the front surface 20 will form one planar surface of the panel, the sidewall form 46 will define its periphery, and another flat surface (not shown in FIG. 1) will be positioned in confronting, spaced relation to the front surface 20 to complete the definition of the panel.

The sidewall form 46 may or may not have a top member 46*a*. For example, as will be discussed, the moldplate may be used for either horizontally or vertically to manufacture pre-cast panel. If used horizontally, the top sidewall 46*a* will be needed to complete encirclement of the panel-defining void 48. On the other hand, if the moldplate 12 is used vertically, either the top sidewall 46*a* is removed, or provided apertures 52, to permit ingress of pourable panel material to the void 48.

The remainder of the sidewall form 46 also includes sidewall members 46*b*, 46*c*, and a bottom member 46*d*. The sidewall and bottom members 46*b*, 46*c*, 46*d* may or may not be integrally formed. Either way, the bottom member 46*d* is dimensioned to have a width approximately 75% wider than that of the lift foot 40 upon which it will rest during formation of a panel to facilitate release of the panel from the moldplate as will be described below.

Figure 6:
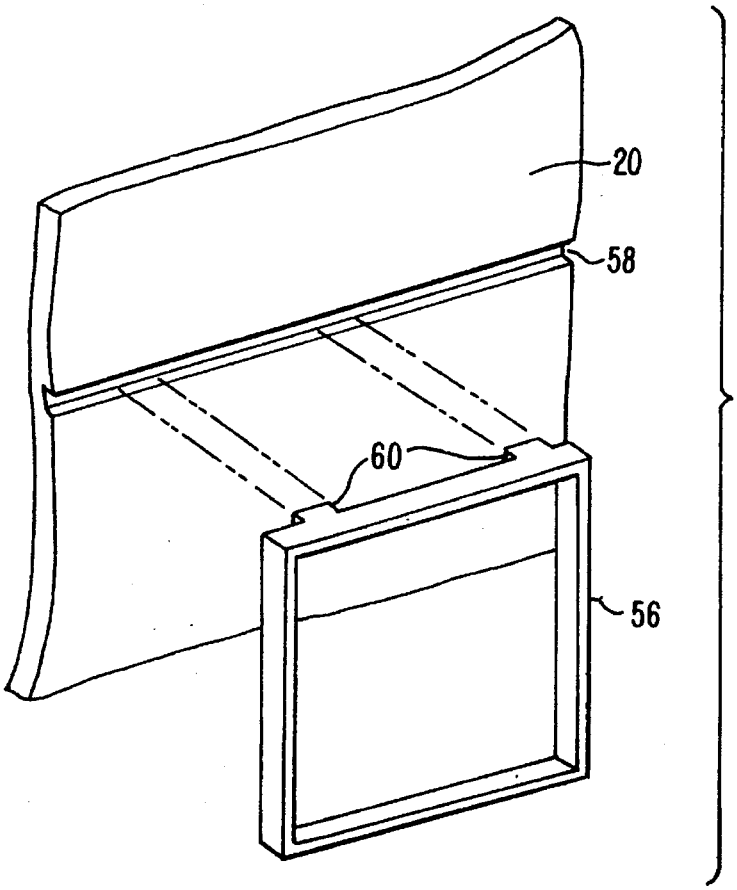
FIG. 6 illustrates removable attachment of a window periphery form to the planar surface of the moldplate of FIG. 1.

If the pre-cast panel is to have a window box, a window box border form 56 may be removably mounted to the front surface 20, and within the void 48, for defining a window box in the prefabricated panel. In the same manner, a doorway border may be defined by a doorway form (not shown) similarly mounted. In order to facilitate mounting the window periphery form, an elongate slot 58, shown in FIG. 6, is formed in the front surface 20 of the moldplate 12. The window form is provided tabs 60 that are received and captured by the elongate notch 58 to position and hold the window form 56 within the void 48 at the desired location. Note that because of the elongate dimension of the notch 58, the window periphery form 56 can be adjusted, relative to the roofline (defined by the sidewall member 46*c*) and/or base (defined by sidewall member 46*b*) of the pre-cast panel.

The plates 14, 16 of the moldplate 12 are three-sixteenths to one-quarter inch steel, although it will be evident to those skilled in this art that other materials and/or thicknesses can be used to form the moldplate 12 provided sufficient structural integrity is achieved for the purpose needed. The lift foot may either be integral with the front plate 14, as illustrated in FIGS. 3 and 4A–4C, or formed separably and affixed, as by welding, to the bottom periphery of the plate 12. The sidewall form may also be three-sixteenths to one-quarter inch steel.

The system 10 can be used in conventional horizontal fashion to manufacture pre-cast panels. If so, the moldplate 12 would be located on a horizontal surface with the front surface 20 facing upward with the sidewall form 46 positioned thereon. If the panel is to have a window box, the window box form 56 (or, alternatively, door periphery form—not shown) positioned as desired on the front surface 20 and within the sidewall form. Not shown for reasons of clarity are the reinforcement bars, such as number 3 reinforcement bar (⅜ inch), that would be situated in the void 48 to form a reinforced concrete panel. Placement of the reinforcement bar is conventional.

A pourable material such as liquid concrete, may then be introduced into the void 48, about the window periphery form 46 and within the sidewall periphery form 46. The panel may be left to dry, which usually takes 20–25 hours, depending upon the particular environment in which the panel is formed. However, according to the present invention, the just-poured, green panel will solidify in about 3–4 hours so that it can be lifted and transported to a curing station by attaching the lift truss 34 to the moldplate 12 by the support tabs 28 as described hereinafter. At the curing station the pre-cast panel is off-loaded from the moldplate so that the moldplate can again be used.

Figure 2:
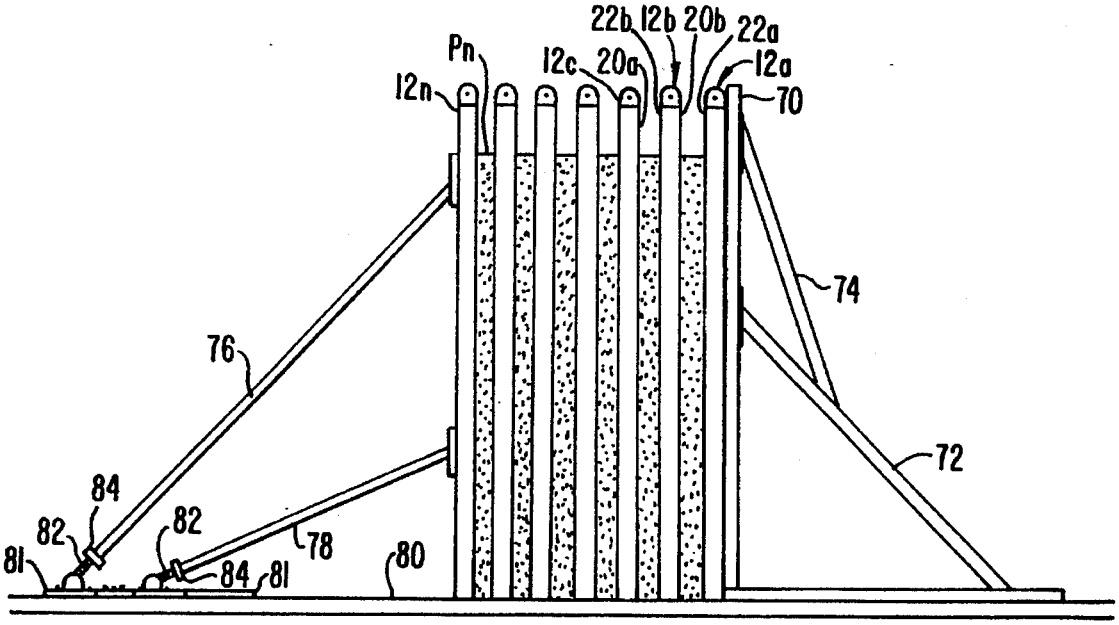
FIG. 2 illustrates use of a number of moldplates constructed as illustrated in FIG. 1 and arranged for vertical manufacture of a number of pre-cast panels.

However, the moldplate 12 is particularly adapted for creating a manufacturing system capable of manufacturing a number of pre-cast panels at once as illustrated in FIG. 2. FIG. 2 shows a number (n) of moldplates 12 (12*a*, 12*b* . . ., 12*n*), constructed as described above, positioned in relative spaced, parallel relation to an upright plate 70. The upright plate 70 provides a planar surface that has the one of the front or back surfaces 20, 22 of moldplate 12*a* in a confronting, spaced relation thereto. Interposed between the front surface 20 of moldplate 21*a* and the planar surface of the plate 70 would be a sidewall form 46 (not shown in FIG. 2).

A second moldplate 12*b* is positioned with its front surface 20*b* substantially parallel to, but spaced from, the back surface 22*a* of moldplate 20*a*. The space between moldplates 12*a* and 12*b* would also contain a sidewall form 46 (not shown). In similar manner, moldplates 12*c*, . . . , 12*n* may be positioned in spaced, relation with confronting surfaces spaced from one another and having sidewall forms placed therebetween—with or without window box (or doorway) forms. The sidewall forms (not shown in FIG. 2) used may either have their respective top members 46*a* removed to permit the introduction of the pourable material into the void defined by the confronting surfaces 20, 22 and the other members (46*b*, 46*c*, 46*d*) of the sidewall forms, or the top member 46*a* may be aperatured as illustrated in FIG. 1.

With the moldplates 12*a*, 12*b*, . . . , 12*n* positioned as illustrated in FIG. 2, a pourable material can be introduced from above the arrangement, and into the respective voids 48 formed between the constructing surfaces 20, 22, to form precast panels P (Pa, Pb, . . . , Pn). Structural support for the upright plate 70 is provided by the braces 72, 74 which operate to position and hold the upright plate 70 in a fixed, vertical position. Support at the other end of the sandwiched configuration of mold plates 12 is provided by extendable, movable braces 76, 78. Preferably, the arrangement of moldplates 12 will sit on parallel, elongate (steel) rails 80. One end of the braces 76, 78 will attach to brace pads 81 that are constructed to slide along the rails 80 to a desired location, and then fixed in place to the rails 80 by any conventional means such as bolts through apertures or the like. Threaded tie rods 82 and corresponding threaded shanks 84 provide the ability to extend or contract the braces 76, 78.

Continuing with FIG. 2, after the panels P have been poured, and allowed to cure for a sufficient amount of time (i.e., 3–4 hours), they will have solidified sufficiently to be moved by the present invention. To do so the lift truss 34 is sequentially attached to each of the moldplates 12, lifted in a manner that provides support to the green panel, and transported to a curing site (FIG. 5) to liberate the upright plate 70 and associated area for an additional pouring.

Figure 3:
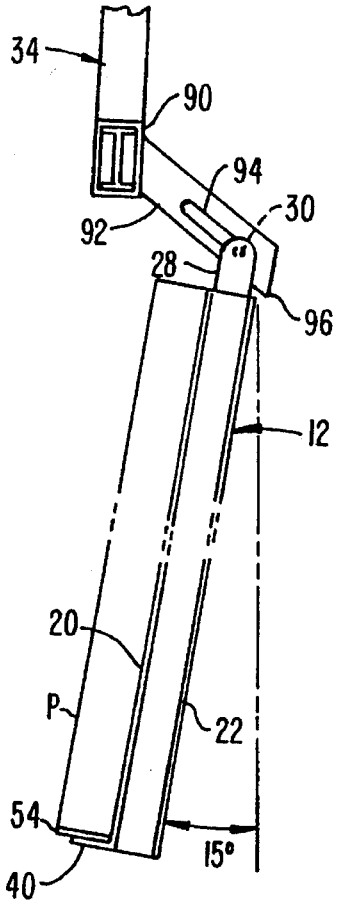
FIG. 3 illustrates lifting the moldplate by the lift truss in a tilted panel-supportive fashion for transporting the panel.

FIG. 3 illustrates operation of the lift truss 34 to lift the moldplate 12 in the manner described to provide support to the still-green panel P. FIGS. 1 and 3, taken in conjunction with one another, show the lift truss as including a cross member 90, to which is fixedly attached a number of downwardly-depending lift arms 92. Formed in each lift arm 92 is an elongate slot 94 located to that the elongate slots 94 are coaxial aligned with one another for receiving the crossbar 30 therethrough.

The lift truss 34 is connected to a moldplate 12 by positioning the lift truss 34 in a manner that aligns the elongate slots 94 with the apertures formed in the support tabs 28 of a moldplate 12. So aligned, the crossbar 30 is inserted through the support tab apertures and elongate slots, as shown in FIG. 1, pivotally attaching the lift truss to the moldplate 12. The crossbar 30 may the be secured in place, such as by screwing nuts onto threaded ends of the crossbar 30.

So attached, the moldplate 12 will be in a substantially vertical position for forming a panel P formed in juxtaposed relation with the front surface 30 of the moldplate 12. The lift truss 34 may then be raised, vertically, such as by a crane or other lift mechanism, and as raised the crossbar 30 will, by the weight of the moldplate 12 and corresponding green panel P, slip downward until reaching the bottom end of the elongate apertures 94 formed in the lift arms 92, as illustrated in FIG. 3.

As FIG. 3 further illustrates, the lower end 96 of each lift arm 92 is constructed to extend a distance beyond the lower end of the aperture 94 so that, as the lift truss is raised to suspend the moldplate therefrom, the end 96 of the lift arm 92 prevents the moldplate 12 from pivoting to a vertical position. The lift point for the moldplate is thereby located beyond the center of gravity of the moldplate 12, tilting it approximately 15 degrees from vertical. This positions the surface (i.e., front surface 12, or back surface 14) of the moldplate 12 that is adjacent the pre-cast panel P in an upward-facing position, i.e., a vector normal to the surface will have a horizontal component, and a upward, vertical component that is sufficient support for the green panel P. The panel P is kept from slipping of the supportive surface of the moldplate by lift foot 40.

Depending upon the construction of the sidewall form 46, it may or may not be removed. If the sidewall construction is that the side members 46*b*, 46*c* are integral with the bottom member 46*d*, the sidewall form 46 will be left with the green panel until cured. Alternatively, if the sidewall form members 46*b*, 46*c* are separate elements from the bottom member 46*d* they may be removed, but the bottom member must remain with the green panel until it has sufficiently cured.

Figure 4A:
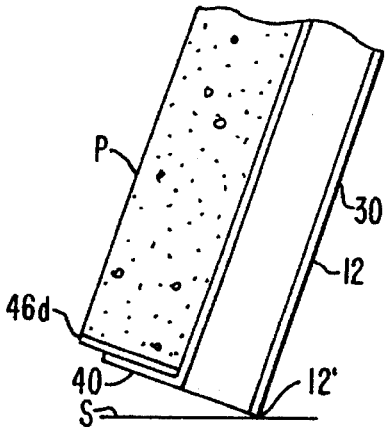
FIGS. 4A, 4B and 4C diagrammatically illustrates disengagement of a green, pre-cast panel from the moldplate that carried it.
Figure 4B:
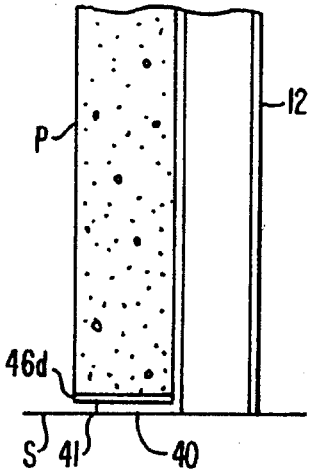

The reason for keeping the bottom member with the panel is that it provides support for the bottom of the panel during curing, but more importantly it facilitates disengagement of the panel from the moldplate. As mentioned above, the lift foot 40 dimensioned to have a width that is approximately 75% less than the bottom member 46*d*, as FIG. 3 illustrates. The reason for these dimensional differences is depicted diagrammatically in FIGS. 4A–4C. When the moldplate is used to transport a green panel from where poured to a curing station, as described above, the panel is deposited by lowering the transporting moldplate 12. When the moldplate is lowered, it will be the back edge 12' that first touches the ground or whatever surface upon which the panel will be placed, due to the tilt with which the panel is transported. FIG. 4A illustrates deposit of the moldplate 12, after transport, with the edge 12' of the back surface 30 of the moldplate 12 placed in contact with the horizontal surface S. When contact with the horizontal surface H is made, the lift truss is moved in a direction (to the left in FIGS. 4A–4C) that causes to the moldplate 12 to rotate, counter-clockwise (as viewed in FIG. 4A) about the edge 12' until flat (FIG. 4B). Continued movement of the lift truss (to the left in FIGS. 4A–4C) will then continue rotation, but now about the edge 41 of the lift foot 40 to tilt the moldplate and corresponding panel P in the manner shown in FIG. 4C. Continuing rotation about the edge 41 of the bottom member 46*d* will ultimately bring the edge 54 into contact with the surface S, allowing further rotation of the panel P about edge 54 until places against a drying rack 100, as shown in FIG. 5, or against another panel already supported by the curing rack 100.

Figure 4C:
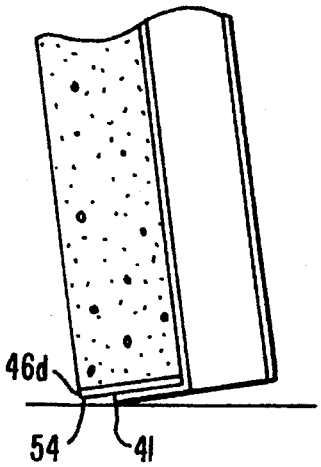

The reason for dimensioning the width of the lift foot 40 less than that of the bottom member 46*d* can now be seen. As FIG. 4C shows, the shorter width of the lift foot 40 prevents the lift foot from being captured by the bottom member 46*b* supporting the panel P. When the panel P is rotated to place it against the drying rack 100 (or against another panel), the lift foot 40 is released for removal. In effect, the bottom member 46*d* forms a release plate that supports the panel P during deposit, as well as during curing.

Figure 5:
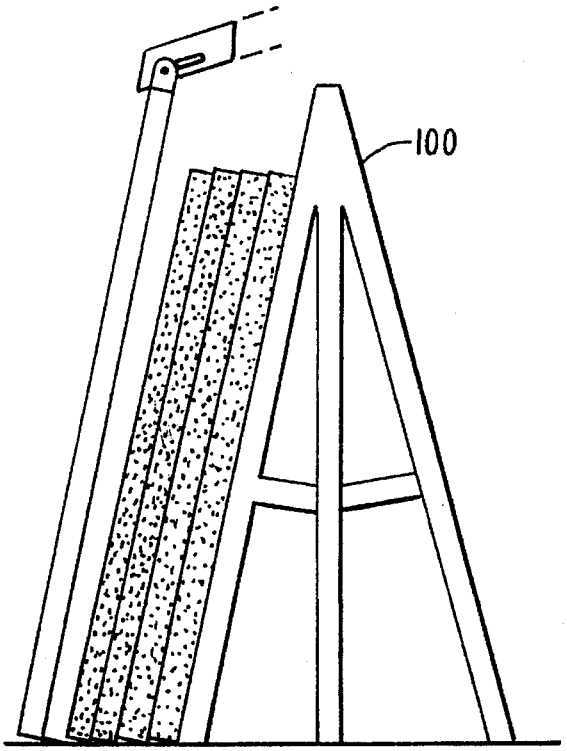
FIG. 5 illustrate a drying rack that is used to support a number of stacked pre-cast panels for curing.

The panel P may be stacked with a number of similar green panels against a drying easel 100, as FIG. 5 illustrates. Preferably, a number of panels P are stacked, as shown in FIG. 5, in registered, juxtaposed relation to minimize or otherwise limit the surface area of each of the panels exposed to ambient environment. By limiting the exposed surfaces of the green panels in this way the panels do not hydrate at a detrimental rate, thereby minimizing, if not entirely eliminating, the damaging effects of direct sunlight, and the need to water the panels P down during their curing stage.

Although a complete and full disclosure of the invention has been set forth herein, certain particulars necessary in the formation of the panels P have not been shown for reasons of clarity. As those skilled in this art will realize, it is desired that the panels P include reinforcement, typically in the form of No. 3 or No. 4 rebar. Such rebar could extend through appropriately placed apertures between the side members 52 of the sidewall periphery form 46 (FIG. 1) during pouring of the pourable material (e.g., liquid concrete). Further, although the lift truss has been described as being attached to the top periphery of moldplate 12, it will now be evident to those skilled in this art that other methods of attachment can be used to achieve the same effect of tilting the panel, when lifted, for transport. For example, a pivotal connection can be made on the vertical sides of the moldplate at locations that cause the moldplate to pivot about the connections, and tilt to position the panel supportive surface at the desired angle.

What is claimed is:

1. Apparatus for placement in confronting, spaced position to a generally upright surface for vertically forming a pre-fabricated panel from a pourable material with a predetermined periphery, the apparatus comprising:

a planar moldplate having a top periphery, a bottom periphery and a mold surface;

a lift foot formed to attach to the bottom periphery to extend generally laterally from the mold surface for supporting the pourable material;

a sidewall mold located on the mold surface having a configuration corresponding to the predetermined periphery;

means removably coupled to the top periphery for lifting and transporting the moldplate such that a vector normal to the mold surface having a horizontal component and an upward, vertical component;

wherein a void is defined by the upright surface and mold surface in confronting relation to one another and the sidewall mold for receiving the pourable material to form the pre-fabricated panel.

2. The apparatus of claim 1, wherein the sidewall mold includes a bottom release plate to underlie and support the pourable material, the bottom release plate being positioned to be supported by the lift foot.

3. The apparatus of claim 2, wherein the release plate is dimensioned to extend substantially between the upright surface and the mold surface.

4. The apparatus of claim 3, wherein the lifting foot has a dimension less than that of the release plate so that the lifting foot does not extend to the upright surface.

5. The apparatus of claim 1, wherein the lifting means includes an elongate lift member horizontally disposed when lifting the moldplate, a number of lift arms, and a plurality of vertical tabs attached to the top periphery of the moldplate, the vertical tabs each having an aperture formed therein so that the apertures of the plurality of tabs are coaxial, and means for attaching the tabs to the lift arms.

6. The apparatus of claim 5, wherein the means for attaching includes means for swivably attaching the tabs to the lift arms.

7. The apparatus of claim 6, wherein the number of lift arms each have formed therein an opening, the openings of the number of lift arms being aligned to receive an elongate lift bar, the elongate lift bar being captured by the apertures in the lift tabs.

8. The apparatus of claim 1, including a box periphery mold positioned in the void for forming a cut-out in the panel.

9. The apparatus of claim 8, including means holding the box periphery mold in a fixed location in the void.

10. The apparatus of claim 9, wherein the holding means includes an elongate groove formed in the mold surface, the box periphery mold including tabs received by the groove.

11. The apparatus of claim 10, wherein the groove is formed horizontally in the mold surface.

12. The apparatus of claim 8, wherein the cut-out formed in the panel is a window box.

13. The apparatus of claim 8, wherein the cut-out formed in the panel is a door periphery.

14. The apparatus of claim 1, wherein the pourable material is liquid concrete.

15. A form for vertically producing a panel for pre-fabricated construction, the panel being formed from a pourable material, the form comprising:

a stationary, generally upright element defining a first mold surface;

a moldplate having a second mold surface defined by a top and a bottom periphery and positioned in confronting, spaced relation to the first mold surface;

a sidewall element positioned between the first and second mold surfaces and defining a void having a panel periphery, the sidewall element being formed to permit ingress to the void of the pourable material;

means coupled to the top periphery for lifting and transporting the moldplate such that a vector normal to the second mold surface has a horizontal component and an upward, vertical component.

16. The form of claim 15, wherein the moldplate defines a third mold surface substantially parallel to the second mold surface and extending between the top and bottom peripheries.

17. The form of claim 16, wherein the moldplate is a first moldplate, and including a second moldplate having a fourth mold surface positioned in confronting spaced relation to the third mold surface, and another sidewall periphery located between the third and fourth mold surfaces to define a additional void therebetween.

18. The form of claim 15, wherein the pourable material is liquid concrete.

* * * * *